United States Patent [19]

Young

[11] 4,282,895

[45] Aug. 11, 1981

[54] FREEZE-PROOF, POLLUTION FREE VALVE

[75] Inventor: Richard E. Young, San Leandro, Calif.

[73] Assignee: Valve Engineering Service Corp., San Leandro, Calif.

[21] Appl. No.: 31,747

[22] Filed: Apr. 20, 1979

[51] Int. Cl.[3] ..... E03B 9/04

[52] U.S. Cl. ..... 137/281; 137/282; 137/301; 251/36

[58] Field of Search ..... 137/272, 281, 282, 291–293; 251/31, 36

[56] References Cited

U.S. PATENT DOCUMENTS 2,630,130 3/1953 Murdock et al. ..... 137/281

4,096,877 6/1978 Arledge ..... 137/301

FOREIGN PATENT DOCUMENTS 25159 12/1883 Fed. Rep. of Germany ..... 137/281

*Primary Examiner*—Martin P. Schwadron
*Assistant Examiner*—G. L. Walton
*Attorney, Agent, or Firm*—Julian Caplan

[57] ABSTRACT

A valve is located below the frost line in the water supply line for a drinking fountain or the like. When the valve is opened, a piston is raised by the water pressure, compressing a spring. When the valve is closed, the spring retracts the piston, sucking the water in the line down below the frost line. Water is retained within the valve and not drained into the surrounding earth. Hence, danger of pollution is reduced.

17 Claims, 5 Drawing Figures

FREEZE-PROOF, POLLUTION FREE VALVE

This invention relates to a new and improved freeze-proof, pollution free valve. One important feature of the present invention is the fact that the valve is located below the frost level rather than at or above the surface and hence the valve is not subject to freezing.

The mechanism within the valve functions to retract into the valve all water which would otherwise remain above it and hence there is no liquid above the valve which is subject to freezing. When the valve is opened, a spring is compressed and after the valve is closed the spring functions to suck water back down from the surface into the valve.

Another feature of the invention is the fact that, contrary to the construction of other freeze-proof valves, there is no drainage of water into the ground. Hence, there is no likelihood that the water supply is polluted by contamination from the soil.

A still further feature of the invention is the fact that the valve is free of maintenance problems, a feature which is important because the valve is located below ground and is not readily accessible.

Another feature of the invention is that the valve may be totally enclosed in a tube extending to the surface and mounted to the base of a drinking fountain or other terminus. By unscrewing the valve from its water-supply line and lifting the tube, the entire valve may be removed without excavation for adjustment, repair or replacement.

Other objects of the present invention will become apparent upon reading the following specification and referring to the accompanying drawings in which similar characters of reference represent corresponding parts in each of the several views.

In the drawings:

FIG. 2 shows the position of the valve when it is first opened.

FIG. 3 shows a further step in the functioning of the valve after it is opened.

FIG. 4 shows the valve fully opened.

FIG. 5 shows the valve after it has been closed and the parts are returning to the closed position of FIG. 1.

Figure 1:
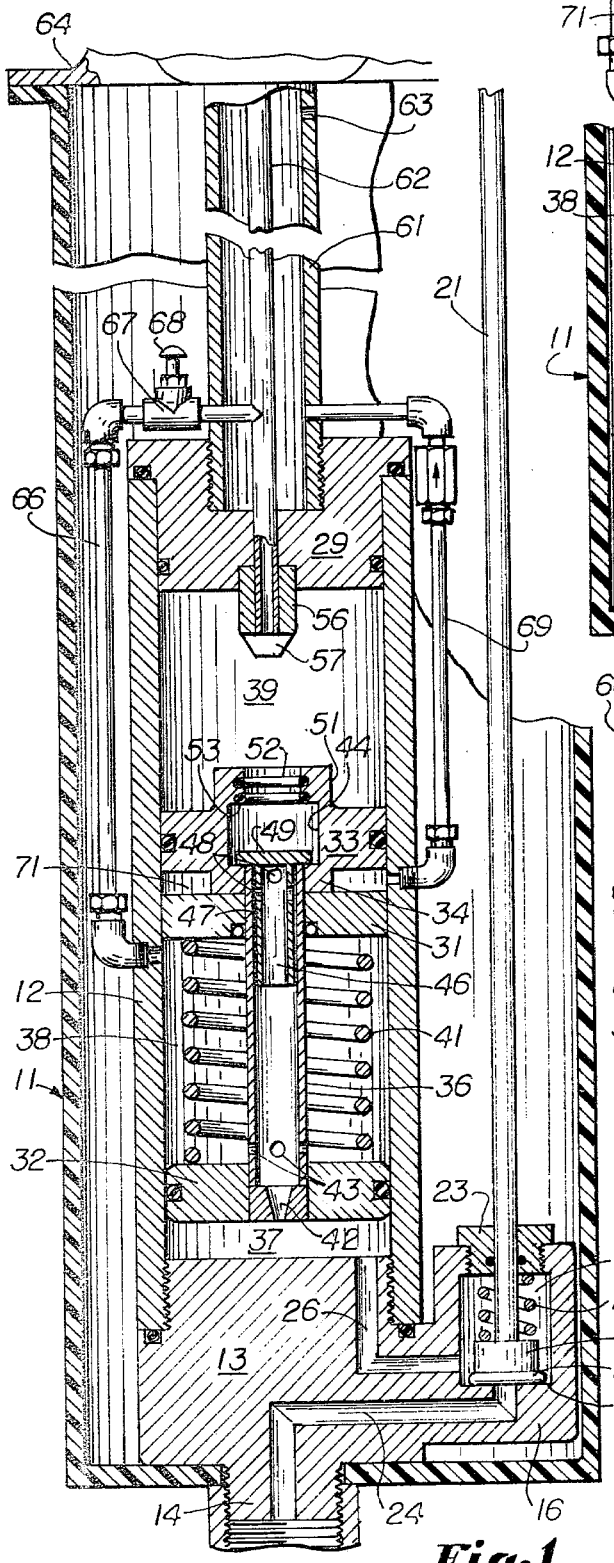
FIG. 1 is a sectional view of a valve in accordance with the present invention showing the valve closed.

Main valve 11 comprises a cylinder 12 having a base 13 closing off the bottom end thereof, the base being provided with a nipple 14 which is connected to the inlet water pipe (not shown). Lateral extension 16 from the base 13 is formed with a manual valve chamber 17 containing a valve seat 18 and a valve disc 19 which reciprocates toward and away from the seat 18 and is provided with a seal ring 20 to seal against the seat 18. Valve stem 21 is connected to disc 19 and extends to the surface where it is actuated by the user to open the valve. Spring 22 in chamber 17 functions to close the valve disk 19 when the user releases the stem 21. Gland 23 seals the stem 21. First duct 24 leads from the water supply to the chamber 17 through the seat 18. Second duct 26 leads from the chamber 17 through the base 13 to the bottom of cylinder 12.

The upper end of cylinder 12 is closed off by a head 29. Transverse partition 31 divides the cylinder 12 into two parts. In the lower part is lower piston 32 and in the upper part is upper piston 33, both of which seal against the wall of cylinder 12. Upper piston 33 has a spacer 34 on its lower end so that the piston 33 is spaced above partition 31 in its retracted position (as in FIG. 1). Tube 36 is secured to pistons 32 and 33 so that they move together. Thus, the interior of cylinder 12 is divided into a lower chamber 37 between the base 13 and the lower piston 32, intermediate chamber 38 between the lower piston 32 and the partition 31 and an upper chamber 39 between the upper piston 33 and the head 29. Spring 41 bears against the underside of partition 31 and the piston 32 to biase piston 32 toward down position (FIG. 1).

Centrally located in lower piston 32 and aligned with tube 36 is a flow control aperture 42 which restricts flow of fluid therethrough. The lower end of tube 36 is provided with a plurality of holes 43 so that water may flow between chambers 37 and 38 through the aperture 42.

Within upper piston 33 is a chamber 44. Control piston 46 has a tube 47 which fits slideably within the tube 36 and has a plurality of holes 48 at its upper end and a head 49 within the chamber 44.

Figure 3:
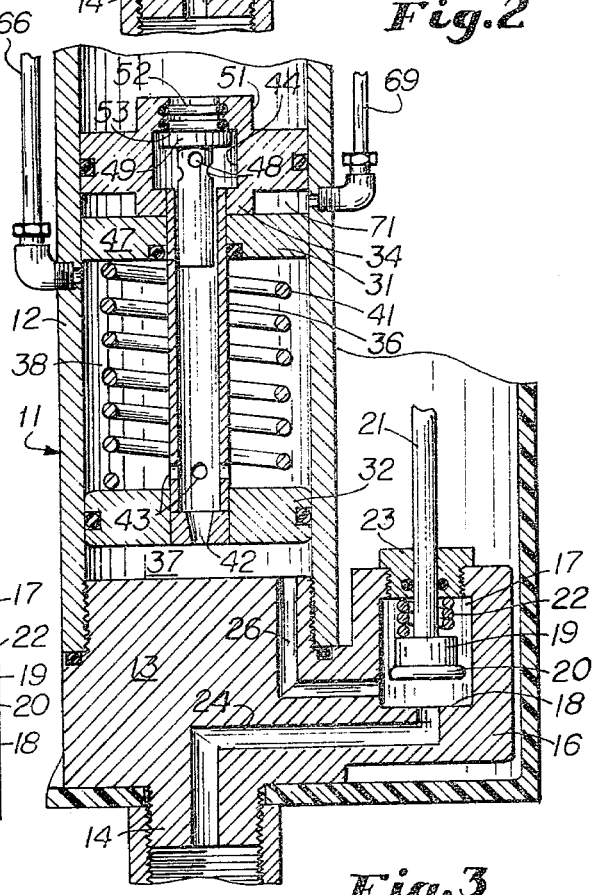

On the upper end of upper piston 33 is an upward extension 51 formed with an enlarged central aperture communicating with chamber 44 and having on its lower edge a seat 53 which is shaped to seal against the top of head 49 (see FIG. 3).

Figure 4:
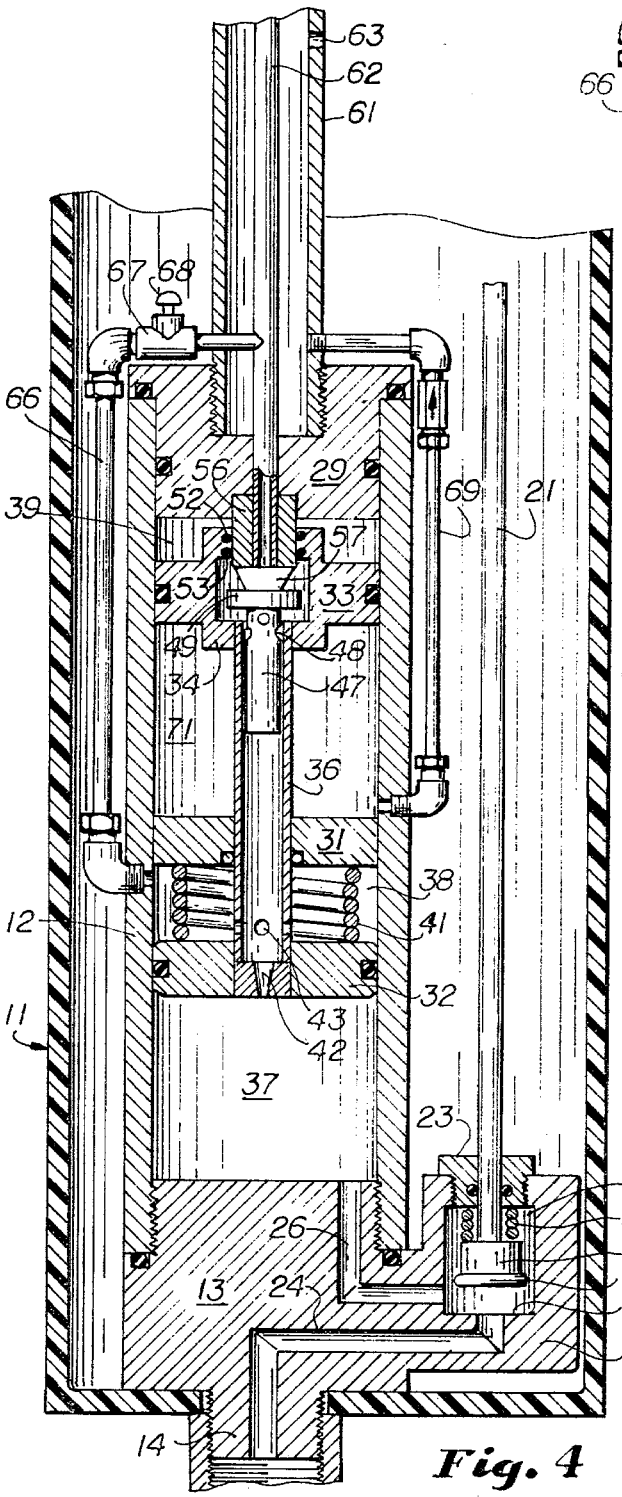

Depending from the lower end of head 29 is a centrally disposed plunger 56 having cut out portions 57. Plunger 56 is dimensioned to fit inside aperture 52 and seal thereagainst (FIG. 4).

Extending upward from head 29 and communicating through the central aperture in head 29 and plunger 56 is an upper tube 61 which leads to the surface, functioning as an air vent 63 and also as a support to hold valve 11 rigid. The upper end of tube 61 may be secured to a mounting plate (not shown) on the surface, which mounting plate may be part of drinking fountain 64. The central duct 62 in tube 61 is the water supply for fountain head 64 of any conventional type.

Tube 66 communicates from a point in the upper end of intermediate chamber 68 to the duct 62. A needle valve 67 in tube 66 has an adjustment 68 to restrict flow through the tube 66. Valve 67 controls the rate at which pistons 32 and 33 rise when valve 16 is opened to prevent water spurting through tube 62 and out the fountain head. In addition, there is a drain duct 69 which communicates with duct 61 through head 29 and cylinder 12 to a point immediately above partition 31. The spacer 34 ensures that when the upper piston 33 is in retracted position (FIG. 1) the lower end of the duct 69 is unobstructed. Air discharged through vent 63, tube 61 and duct 69 eliminates back pressure and enables spring 41 to fully retract pistons 32 and 33. Check valve 78 prevents air from being sucked down duct 69.

The operation of the devices is as follows:

In the condition shown in FIG. 1 the valve is completely off because the seal ring 20 of disc 19 has sealed against the seat 18. When the user operates a handle or pedal, stem 21 is raised to the position shown in FIG. 2, compressing spring 22 and disengaging ring 20 from seat 18. Thereupon water flows through the duct 24, chamber 17 and duct 26 to the lower main valve chamber 37.

Figure 2:
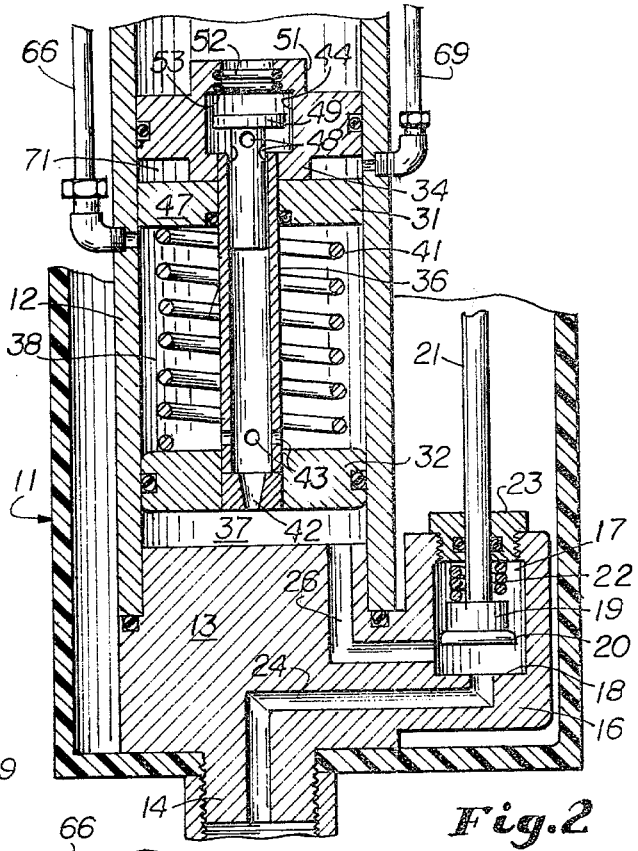
FIGS. 2, 3, 4 and 5 are sectional views showing a sequence of operations. Thus.

Water then flows through the constricted aperture 42 into the tube 36. Because the intermediate chamber 38 is full of water (from previous use) and the valve 67 is constricted in its opening, the pressure of the water causes the control piston 46 to rise but some water rises through holes 43 to chamber 38 through tube 66 and valve 67 into duct 62 and up to head 64 in a restricted flow, therefor without a spurt. An intermediate position of the control piston 46 is shown in FIG. 2. Continued water pressure causes control piston 46 to rise to full up position of FIG. 3, with head 49 sealing against the seat 53. Flow of water is inhibited by the sealing of member 49 against member 53. Continued water pressure causes the pistons 32 and 33 to rise together, forcing water up through the duct 62 to the surface and also compressing spring 41. When the piston 33 approaches its full up position, plunger 56 enters the aperture 52 and depresses the control piston 46 (see FIG. 4). Major flow is from chamber 37, through aperture 42, up tube 36 and tube 47 through holes 48, into chamber 44 and up through aperture 52, plunger 56 and duct 62 to head 64. There is also a minor flow of water after the parts reach the position of FIG. 4 from the lower chamber 37, up the constricted aperture 42, through the holes 43 into the chamber 38 and thence up through the tube 66 and valve 67 into the duct 62 and up to the fountain head 64. Such flow continues so long as the user is actuating the stem 21.

Figure 5:
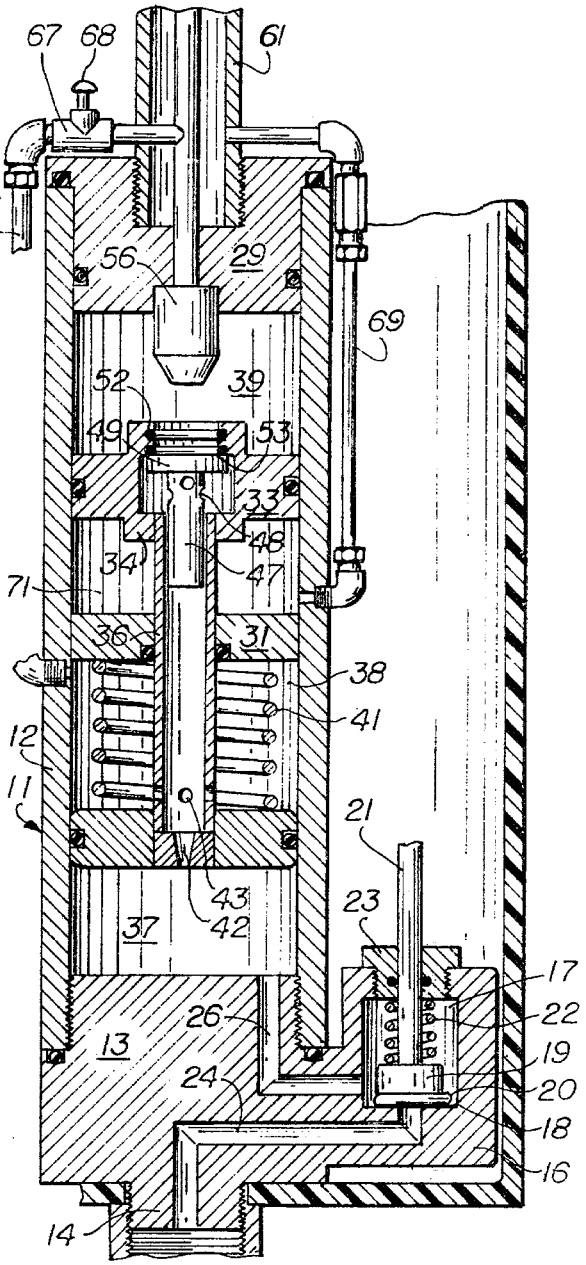

When the user releases the handle or pedal which has elevated stem 21, spring 22 restores ring 20 to closed position, shuting off flow of water into the valve 11. It will be observed that the spring 41 has previously been compressed from the position of FIG. 1 to the position of FIG. 4 as the piston 32 has risen to the top of its stroke. When the water pressure is released, the spring 41 retracts the pistons 32, 33 to their initial position, an intermediate position being shown in FIG. 5. The control piston 46 rises to up position as soon as it is disengaged from contact with plunger 56. Hence, the downward movement of piston 33 sucks water from the head 64 down through the duct 62 into the chamber 39. The bleed 63 prevents a vacuum in the duct 62. As upper piston 33 moves downward, air pressure in chamber 71 between partition 31 and piston 33 is forced out through tube 69 into duct 62 and bleed 63.

Since all the water is retained within the valve 11, there is no possibility of contamination in units which drain the unused water from chamber 69 into the surrounding earth.

Valve 67 governs the rate of travel of the piston, eliminating the possibility of water suddenly spurting out the head 64 onto the ground.

It is desirable that the entire assembly of valve 11 lateral extension 16 and tube 61 be encased in a tube 76 of PVC or other substance which leads to the surface. By rotating tube 76, nipple 14 may be disconnected from its water pipe and the entire assembly lifted to the surface for inspection, repair and replacement. The upper end of tube 76 may be bolted to a ground mounting plate for the fountain.

What is claimed is:

1. A valve comprising a substantially closed cylinder having a first end and a second end, said valve being divided by a transverse partition into a first portion and a second portion, a first piston reciprocable in said first portion and a second piston reciprocable in said second portion, first means for causing said pistons to move together, resilient means biasing said pistons toward said first end, manually operable second means for admitting fluid under pressure into said first portion near said first end, third means for transmitting fluid from said second end to a point remote from said valve, an opening in said first piston permitting constricted fluid flow from said first end past said first piston, fourth means transmitting fluid from said first end of said first portion through said first means and through said second piston, fifth means cutting off flow through said third means when said second means is open and also when said second piston is moved toward said first end when said second means is closed, sixth means activates said fifth means when said second piston is adjacent said second end to allow fluid to flow from said fourth means into said third means, and when said second means is open said pistons are moved away from said first end by fluid pressure and when said second means is closed said resilient means biases said pistons away from said second end, said second piston thereby sucking fluid out of said third means.

2. A valve according to claim 1 in which said constricted opening admits pressure fluid from said second means into said first end force said first piston away from said first end while permitting fluid flow into the space between said first piston and said partition.

3. A valve according to claim 2 which further comprises a conduit extending from a point in said first portion adjacent said partition into said third means.

4. A valve according to claim 3 which further comprises adjustable means in said conduit to regulate the velocity of flow through said conduit and thereby to regulate the rate of movement of said pistons.

5. A valve according to claim 4 in which initial fluid flow into said third means is through said conduit, thereby preventing spurt of fluid through said third means after said second means has been opened.

6. A valve according to claim 1 which further comprises a drain duct from said third means into said second portion adjacent said partition, said third means having a bleed to atmosphere.

7. A valve according to claim 1 in which said first means comprises a member extending through said partition and fixed at opposite ends to one of said pistons.

8. A valve according to claim 7 in which said member is a tube apertured above said first piston and communicating with said opening.

9. A valve according to claim 8 in which said second piston is formed with a chamber, said tube communicating with said chamber, said chamber having an aperture leading into said second portion between said second piston and said second end.

10. A valve according to claim 9 in which said fourth means comprises a second tube partially within said chamber and reciprocable in said first mentioned tube, said second tube being apertured to permit fluid flow into said chamber from said first portion.

11. A valve according to claim 10 in which said fifth means comprises an impervious head on said second tube and seal means around said aperture whereby when said seal means engages said head fluid flow from said chamber through said aperture is terminated.

12. A valve according to claim 1 in which said sixth means comprises a plunger extending from said second end positioned and dimensioned to extend through said aperture to break engagement of said head with said seal means when said second piston is adjacent said second end.

13. A valve according to claim 1 in which said second means comprises a second valve and actuating means for said second valve operable from a point remote from said first mentioned valve.

14. A valve according to claim 13 which further comprises second resilient means biasing said second valve closed.

15. A valve according to claim 1 in which said valve is located below the frost line and said third means extends up to a point above the ground level.

16. A valve according to claim 15 which further comprises a fountain head on the upper end of said third means.

17. A valve according to claim 15 which further comprises an air bleed on said third means above ground level.

* * * * *